United States Patent [19]

Knapp

[11] Patent Number: 4,969,483

[45] Date of Patent: Nov. 13, 1990

[54] DEVICE AGAINST SIPHON BACK FLOW, FOR HYDRAULIC VALVES HAVING A CARTRIDGE WITH PLANE PLATES FOR FLUX CONTROL

[75] Inventor: Alfons Knapp, Biberach an der Riss, Fed. Rep. of Germany

[73] Assignee: Gevipi A.G., Vaduz, Liechtenstein

[21] Appl. No.: 493,312

[22] Filed: Mar. 14, 1990

[30] Foreign Application Priority Data

Mar. 29, 1989 [IT] Italy ..... 67216 A/89

[51] Int. Cl.[5] ..... E03C 1/10

[52] U.S. Cl. ..... 137/218; 137/217; 137/454.6; 137/625.17; 137/625.4

[58] Field of Search ..... 137/217, 218, 454.6, 137/625.17, 625.4, 852

[56] References Cited

U.S. PATENT DOCUMENTS 3,172,426 3/1965 Cole ..... 137/454.6 X
4,508,136 4/1985 Kah ..... 137/217 X
4,696,322 9/1987 Knapp et al. .
4,827,538 5/1989 Heimann et al. ..... 137/217 X
4,876,006 10/1989 Iqbal ..... 137/628.17 X

*Primary Examiner*—Gerald A. Michalsky
*Attorney, Agent, or Firm*—Young & Thompson

[57] ABSTRACT

A hydraulic faucet intended to house a cartridge containing flux control members shaped as plane plates of hard material, and comprising a valve body and a removable cover, wherein some inlet passages for ambient air are provided for in register with the faucet cover, and a one-way valve with elastic lip is housed within the cover, between an outer region of the faucet, communicating through the inlet passages with the outside ambient, and an inner region of the faucet, communicating with the delivery outlet of the faucet. This one way valve with elastic lip is inserted in such sense that it remains sealingly closed when the pressure in the inner region of the faucet is not lower than the ambient air pressure which is present in the outer region of the faucet, and it automatically opens when the pressure in the inner region of the faucet decreases, even of a slight amount, under the ambient air pressure, so that no siphon back flow may arise.

11 Claims, 1 Drawing Sheet

DEVICE AGAINST SIPHON BACK FLOW, FOR HYDRAULIC VALVES HAVING A CARTRIDGE WITH PLANE PLATES FOR FLUX CONTROL

BACKGROUND OF THE INVENTION

This invention relates to a device intended to prevent the siphon back flow in the hydraulic faucet valves comprising a cartridge which contains flux control members shaped as plane plates of hard material.

When a faucet valve is used to control a flux through a shower or any other delivery member which is connected through a hose, there is the possibility that the delivery member is immersed in a liquid containing basin. If, in such circumstances, the water delivery is interrupted and the supply pipes are evacuated, for example in order to proceed to a repair, within the pipes there may establish a transitory underpressure. As a consequence of such underpressure, if the faucet is open there may take place a siphon back flow, and some liquid contained in the basin is sucked, through the delivery member and the faucet, up to the supply pipe. This leads to a possible pollution of the supply pipe and possibly of the aqueduct too.

In order to prevent such phenomenon, the showers and other delivery members intended to be connected to a faucet through a hose are usually provided with a back flow preventing valve. However the operation of such back flow preventing valves may easily be hindered by foreign bodies or dirt, and for this reason some regulations impose that the installations referred to should be provided with protection means suitable for preventing the establishment of any underpressure downstream of the faucet.

Mounting a special aeration valve, arranged downstream of the faucet, which allows air inlet when an underpressure arises, gives a solution to this problem, but involves undesiderable additional costs. On the contrary it is desirable that such an aeration valve be embodied in the faucet itself. This problem has been already solved with respect to faucets having a ball shutter. Therein the valve may be located within the ball shutter, by giving rise to a very limited increase in cost.

On the contrary, this problem has not been solved as yet with respect to the hydraulic faucet valves provided with a cartridge comprising flux control members shaped as plane plates of hard material. Mounting an aeration valve within a cartridge of this kind raises problems whose solution is somewhat difficult, and moreover involves the need for manufacturing special cartridges which differ from the usual ones in being provided with an aeration valve. This is undesirable, on one hand because of the increase in the number of cartridge types to be manufactured, and on the other hand because the wrong replacement of a usual cartridge to a cartridge provided with aeration valve could easily lead to unintentionally violate the prevention regulations. On the contrary, it is desirable that the aeration valve be embodied in the faucet rather than in the replaceable cartridge, whereas on the other hand it is also desirable that usual cartridges may be mounted in a thus equipped faucet valve.

SUMMARY OF THE INVENTION

Therefore, the main object of this invention is to create a hydraulic faucet valve of the type intended to receive a cartridge which contains flux control members shaped as plane plates of hard material, which faucet should comprise within itself an aeration valve independent from the cartridge. Another object of the invention is to realize a faucet valve having the already mentioned characteristic, which moreover should be suitable for receiving a usual cartridge of the type customarily mounted in the faucets not having an aeration valve. A further object of the invention is to attain the above mentioned objects by involving only a slight increase in manufacturing costs.

The above main object is attained, according to the invention, by means of a hydraulic faucet valve intended to receive a cartridge which contains flux control members shaped as plane plates of hard material, and comprising a faucet body and a removable cover, characterized in that some inlet passages for ambient air are provided for in register with the faucet cover, and that a one-way valve with elastic lip is housed within said cover, between an outer region of the faucet, communicating through said inlet passages with the outside ambient, and an inner region of the faucet, communicating with the delivery outlet of the faucet, said one-way valve with elastic lip being inserted in such direction that it remains sealingly closed when the pressure in the inner region of the faucet is not lower than the ambient air pressure which is present in said outer region of the faucet, and to automatically open when the pressure in the inner region of the faucet decreases, even of a slight amount, under the ambient air pressure.

Thanks to these features, during the normal operation of the faucet valve, when the pressure in the inner region of the faucet can never be lower than the ambient air pressure, the one-way valve with elastic lip remains closed. Particularly, during the delivery of water the pressure in the inner region of the faucet becomes higher than the ambient air pressure, and the one-way valve with elastic lip is kept by this pressure sealingly pressed, whereby any loss of water through the inlet passages is prevented. However, if circumstances tending to give rise to a siphon back flow arise, the pressure in the inner region of the faucet decreases, even if only of a slight amount, under the ambient air pressure, and then the one-way valve with elastic lip automatically opens, thus allowing inlet of air through the inlet passages up to the inner region of the faucet, which communicates with the delivery outlet. Therefore, at this outlet can never establish any noticeable underpressure, thus surely preventing any siphon back flow.

The described principle of the invention may be constructively realized in various manners, both with respect to the disposition of the inlet passages and with respect to the arrangement of the one-way valve with elastic lip and of the member which offers a valve seat therefor.

With reference to the disposition of the inlet passages provided for in register with the faucet cover, a first arrangement is that said passages are formed by openings made in the cover. Another arrangement is that said passages are formed by channels made partially around an opening shown by the cover for coupling with the contained cartridge, and partially in the outer region of the cartridge. A third arrangement is that said passages are formed by channels made only in the opening shown by the cover for coupling with the cartridge. A fourth arrangement is that said passages are made only in the outer region of the cartridge.

With reference to the disposition of the one-way valve with elastic lip, this valve may be arranged between the faucet cover and the contained cartridge, or even between the cover and the faucet body. In this latter case the elastic body forming the one-way valve with elastic lip may also assume the function of a seal packing which should be inserted between the cover and the faucet body.

With reference to the disposition of the member which offers a valve seat for the one-way valve with elastic lip, this member may be an inner surface of the faucet cover, or an inner surface of the faucet body, or even a collar-shaped surface of the cartridge.

BRIEF DESCRIPTION OF THE DRAWING

The characteristics and advantages of the subject of the invention will appear more clearly from the following description of some embodiments, which are given as non limiting examples and are diagrammatically shown in the appended drawing, wherein.

DETAILED DESCRIPTION OF THE PREFERRED EMBODIMENTS

Figure 1:
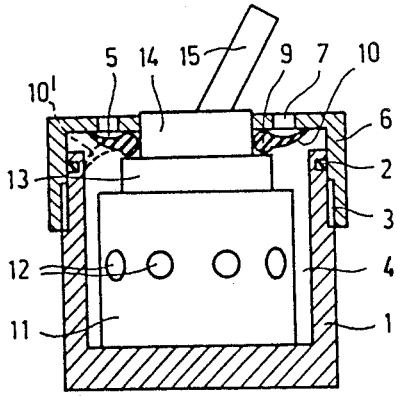
FIGS. 1 to 4 show in a very diagrammatical way the axial sections of some embodiments of the invention, which differ from one another in the arrangements of the inlet passages, the one-way valve with elastic lip and the valve seat; in all these Figures, the cartridge housed within the faucet is shown in external view.

With reference at first to FIG. 1, it may be seen that the diagrammatically shown faucet comprises a hollow body 1 and a cover 6, which is screwed onto the body 1 by means of a thread 3. A seal packing 2 is inserted between body 1 and cover 6. Within the inner cavity of body 1 there is housed a cartridge, of which are shown the casing 11 traversed by delivery openings 12, a collar shaped portion 13 and a top portion 14 from which extends a control member 15. The parts 14 and 15 of the cartridge pass through a central opening of cover 6.

In this embodiment, the inlet passages are formed by apertures 7 made through the cover 6. Between an annular region of this latter and the collar shaped portion 13 of the inner cartridge there is arranged an annular body 9 of elastic material, from which extends outwards an elastic lip 10. This latter extends beyond the apertures 7 and rests against the inner surface of cover 6, this surface acting as valve seat. Therefore, the lip 10 divides the inner space of the faucet body 1 in an inner region 4, which communicates with the delivery openings 12 of the cartridge, as well as with any delivery passage (not shown) forming the outlet of the faucet, and an outer region 5, which communicates with the outside ambient through the apertures 7 of cover 6.

As long as the pressure in the inner region 4 is not lower than the external pressure present in the outer region 5, the lip 10 remains sealingly resting against the inner surface of cover 6. In particular, during the delivery of water by the open faucet, the pressure in the inner region 4 increases, due to the resistances opposed to the flow downstream of the faucet, and forcedly presses the lip 10 against the cover 6, thus preventing any water leakage through the passages 7.

If, on the contrary, circumstances arise which tend to give rise to a siphon back flow, the pressure in the inner region 4 becomes at least slightly lower than the external pressure, and therefore this latter, by acting in the outer region 5 against the elastic lip 10, removes this lip from the cover 6. Then the ambient air may freely enter the inner region 4 of the faucet body 1, thus compensating for the underpressure which aimed to establish there, whereby the underpressure cannot assume any noticeable value and any siphon back flow is prevented. The elastic body 9 with the lip 10 acts therefore as a one-way valve preventing the siphon back flow.

In this embodiment, the elastic body 9 of the one-way valve with elastic lip acts as a spacer for keeping in position the cartridge 11-15 within the faucet body 1, but it has no function in establishing a seal between the faucet body and the cover.

FIG. 1 also shows, as a modification, how one may alternatively shape the elastic lip 10' of the one-way valve. In this case the lip, instead of sealing against the inner surface of cover 6, seals against the inner surface of the faucet body 1, which in this case assumes the function of a valve seat.

It will be understood that the operation of a thus modified valve does in no way change; merely, in the conditions of preventing the siphon back flow it is removed from the inner surface of body 1, rather than from the inner surface of cover 6.

Figure 2:
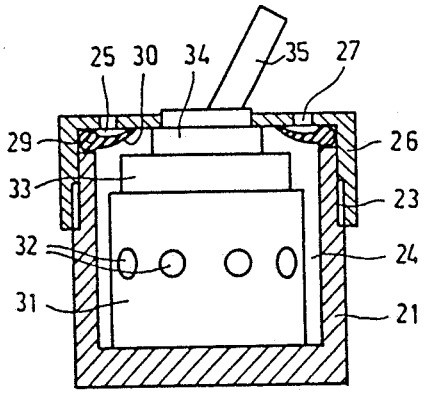

In the embodiment shown in FIG. 2, the different parts of the faucet, the cartridge and the one-way valve which correspond to those of FIG. 1 are designated by the same reference numbers increased by 20, and they will not be further described. In the present case, the cartridge directly rests against the cover 26, and the annular body 29 of the one-way valve is compressed between the body 21 and the cover 26 of the faucet. In this way it also operates as a seal packing between said parts, and therefore there is no more the seal packing 2 according to FIG. 1. Apart from this, the behavior obtained is completely identical to that described with reference to the embodiment according to FIG. 1.

Figure 3:
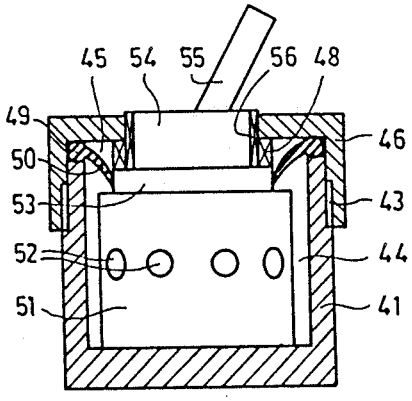

In the embodiment shown in FIG. 3, the different parts of the faucet, the cartridge and the one-way valve which correspond to those of FIG. 1 are designated by the same reference numbers increased by 40, and they will not be further described. In the present case too, as according to FIG. 2, the annular body 49 of the one-way valve is compressed between the body 41 and the cover 46 of the faucet and it also operates as a seal packing between said parts. However the lip 50 of the one-way valve is directed towards the collar shaped portion 53 of the cartridge, which in this case assumes the function of a valve seat. The inlet passages could still be formed by apertures made through the cover 46, as in the foregoing cases, however here they may also be formed by channels 56 made in the outer portion 54 of the cartridge, and by registering channels made in an inner flange 48 of cover 46, serving as a shoulder for the cartridge. Apart from this, the behavior obtained still is completely identical to that described with reference to the embodiment according to FIG. 1.

Figure 4:
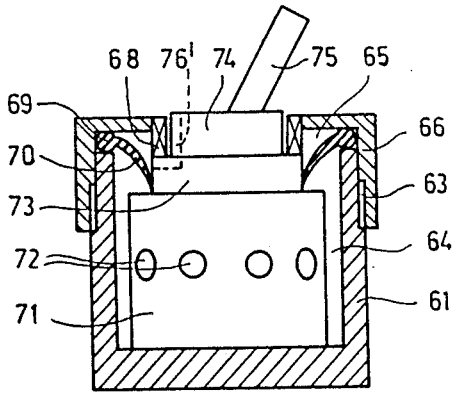

In the embodiment shown in FIG. 4, which is very similar to that according to FIG. 3, the different parts of the faucet, the cartridge and the one-way valve which correspond to those of FIG. 1 are designated by the same reference numbers increased by 60, and they will not be further described. Also in the present case, the annular body 69 of the one-way valve is compressed between the body 61 and the cover 66 of the faucet, and it also operates as a seal packing between said parts, whereas the lip 70 of the one-way valve is directed towards the collar shaped portion 73 of the cartridge, which assumes the function of a valve seat. In this case, the inlet passages are formed by channels made in an inner flange 68 of cover 66, and they extend outwards, whereby there is no need for providing channels made in the outer portion of the cartridge. Apart from this, the behavior obtained still is completely identical to that described with reference to the embodiment according to FIG. 1.

FIG. 4 also shows, as a modification, that channels 76' forming inlet passages could be made only in the outer region of the cartridge, and in such a case it is not necessary to provide for channels in the shoulder flange 68 of cover 66.

As it appears from the different embodiments described, it is possible to choose arrangements thanks to which the faucet comprising the device against the siphon back flow is suitable for receiving the same cartridges customarily manufactured for faucets not having said device. Alternatively, it is possible to manufacture cartridges having arrangements specifically intended to allow operation of a device against the siphon back flow, which however may also be used in faucets not having such a device. Moreover it is evident that all the arrangements according to the invention, which protect a faucet against the siphon back flow, may be realized without any important increase of the manufacturing costs with respect to faucets of the same kind, not having such a protection.

Figure 5:
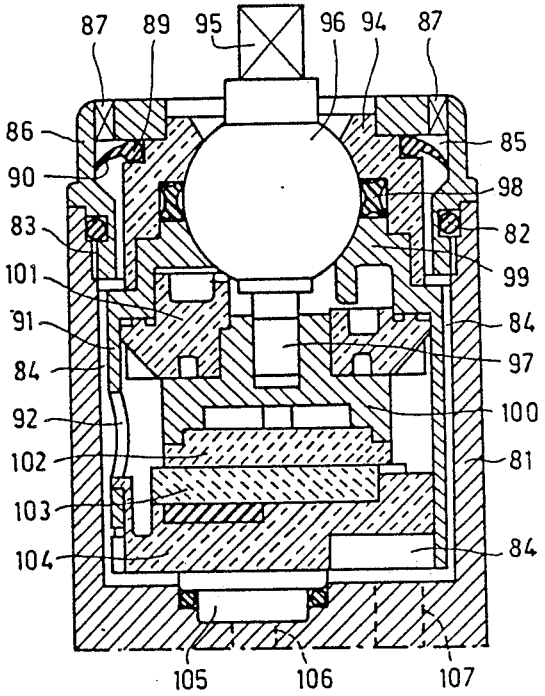
FIG. 5 shows in a more detailed manner an embodiment, wherein the cartridge is shown in section too.

In the embodiment shown in more detail in FIG. 5, the different parts of the faucet, the cartridge and the one-way valve which correspond to those of FIG. 1 are designated by the same reference numbers increased by 80, and they will not be further described. This embodiment corresponds to that of FIG. 1, but it shows that the inner surface of cover 86, which acts as a valve seat, may also be the inner cylindrical surface of the cover, instead of the plane inner surface as it was according to FIG. 1. In the present Figure it appears that the lever control member 95 is connected to an articulation ball 96, mounted between the top portion 94 of the cartridge, which forms a top half bearing, and a bottom half bearing 99 being a part of casing 91. A seal packing 98 is inserted between said parts. The inner end 97 of the control member engages a slider 100, which is guided within the cartridge by a guide ring 101 and is connected with a movable control plate 102 of hard material. This latter slides contacting a fixed control plate 103 of hard material, mounted in a bottom 104 of the cartridge casing 91. The bottom 104 is connected by means of projections 105 with inlet seats of the faucet body 81, wherein open the supply pipes 106. Number 107 designates a possible disposition of the delivery passage, which however may also be provided in any other position, consistently with the installation needs. The operation of a faucet and a cartridge as those now described is per se well known and does not require to be described in detail.

The inner region 84 of the faucet body communicates with the delivery passage 107, and it receives the water, which has been mixed within the cartridge, through the openings 92 of the cartridge casing 91. Said inner region extends, through the interstice between the cartridge casing 91 and the faucet body 81, up to the one-way valve 89–90, which in normal conditions separates said inner region from the outer region 85 communicating with the ambient air through the apertures 87 of cover 86. When there is a slight underpressure in the inner delivery region 84, the lip 90 of the one-way valve is removed from the inner cylindrical wall of cover 84 and allows the external air, which through the passages 87 always arrives to the outer region 85 of the faucet body, to arrive up to the inner region 84 and therefore to the delivery passage 107. Therefore, even if an underpressure, which may establish in the supply pipe when the faucet is open, gives rise to a suction through the faucet, the sucked matter is only air entering through the passages 87, the outer region 85, the moved lip 90 of the one-way valve and the inner region 84 of the faucet body, whereas no suction may be transmitted to the delivery passage 107 and give rise to a siphon back flow.

Of course, all described particulars may be replaced by their technically equivalent means, without modifying the behavior of the device.

What is claimed:

1. In a hydraulic faucet valve comprising a hollow faucet body, a removable cover closing said body, a cartridge housed within said hollow body and said cover, inlet connections and a delivery outlet, said cartridge comprising flux control members shaped as plane plates of hard material, and said cover having an opening coupled with said cartridge, the improvement that the faucet valve comprises some inlet passages for ambient air, provided for in register with said faucet cover, a one-way valve having an elastic lip, housed within said faucet body and cover, said one-way valve dividing the space inside said faucet body and cover into an outer region and an inner region, said outer region of the faucet communicating through said inlet passages with the outside ambient, and said inner region of the faucet communicating with said delivery outlet of the faucet, said one-way valve with elastic lip being inserted in the sense that allows flow from said outer region to said inner region of the faucet and not vice-versa, whereby said one-way valve remains sealingly closed when the pressure in said inner region of the faucet is not lower than the ambient air pressure which is present in said outer region of the faucet, and it automatically opens when the pressure in the inner region of the faucet decreases, even of a slight amount, under the ambient air pressure, thus preventing siphon back flow.

2. A faucet valve as set forth in claim 1, wherein said inlet passages are formed by openings made in said faucet cover.

3. A faucet valve as set forth in claim 1, wherein said inlet passages are formed by channels made partially around said opening of the cover coupled with the contained cartridge, and partially in an outer region of said cartridge.

4. A faucet valve as set forth in claim 1, wherein said inlet passages are formed by channels made only in said opening of the cover coupled with said cartridge.

5. A faucet valve as set forth in claim 1, wherein said inlet passages are formed by channels made only in an outer region of said cartridge.

6. A faucet valve as set forth in claim 1, wherein said one-way valve with elastic lip is inserted between said faucet cover and the contained cartridge.

7. A faucet valve as set forth in claim 1, wherein said one-way valve with elastic lip is inserted between said faucet cover and said faucet body.

8. A faucet valve as set forth in claim 7, wherein said one-way valve inserted between said faucet cover and said faucet body comprises an elastic body also having the function of a seal packing.

9. A faucet valve as set forth in claim 1, wherein said one-way valve with elastic lip cooperates with an inner surface of said faucet cover, which acts as a valve seat.

10. A faucet valve as set forth in claim 1, wherein said one-way valve with elastic lip cooperates with an inner surface of said faucet body, which acts as a valve seat.

11. A faucet valve as set forth in claim 1, wherein said cartridge has a collar-shaped portion, and said one-way valve with elastic lip cooperates with said collar-shaped surface of the cartridge, which acts as a valve seat.

* * * * *